US005096431A

United States Patent [19]

Byrne

[11] Patent Number: 5,096,431

[45] Date of Patent: Mar. 17, 1992

[54] OUTLET RECEPTABLE WITH REARRANGEABLE TERMINALS

[76] Inventor: Norman R. Byrne, 2736 Honey Creek, NE., Ada, Mich. 49301

[21] Appl. No.: 619,104

[22] Filed: Nov. 28, 1990

[51] Int. Cl.[5] ..... H01R 25/16; H01R 29/00

[52] U.S. Cl. ..... 439/171; 439/215

[58] Field of Search ..... 439/43, 52, 110, 111, 439/207-216, 189, 31, 32, 162-165, 170, 171, 172, 174, 175; 174/68, 69

[56] References Cited

U.S. PATENT DOCUMENTS

| | | | |
|---|---|---|---|
| 891,343 | 6/1908 | Keller | 439/32 |
| 3,832,503 | 8/1974 | Crane | 439/110 |
| 3,993,385 | 11/1976 | Seger | 439/122 |
| 4,005,298 | 1/1977 | Brown | 174/69 |
| 4,108,523 | 8/1978 | Bolis | 439/121 |
| 4,367,370 | 1/1983 | Wilson et al. | 439/215 |
| 4,666,223 | 5/1987 | Tillmann | 439/221 |
| 4,671,585 | 6/1987 | Langer et al. | 439/117 |
| 4,781,609 | 11/1988 | Wilson et al. | 439/215 |

*Primary Examiner*—Neil Abrams

*Attorney, Agent, or Firm*—Varnum, Riddering, Schmidt & Howlett

[57] ABSTRACT

An electrical outlet receptacle block is provided with input terminals movable to selected positions for engagement with terminals of an electrical junction block having a plurality of terminals representing a plurality of different electrical circuits. The outlet receptacle block has neutral, ground and positive flexible conductor bars electrically connected to neutral, ground and positive receptacle output terminals, respectively. Input terminals of the receptacle block are formed integral with the flexible conductor bars and levers are provided for moving the terminal ends of the flexible conductor bars to physically different positions. In one configuration, the receptacle block housing is provided with openings at opposite ends and the flexible conductor bars have terminal ends controlled by levers at both ends of the outlet receptacle block. In another configuration, the receptacle block has output terminals in a front wall and the input terminals of the receptacle block are formed as ends of the flexible bars and extending at an approximately 90-degree angle to the bars and through openings in the back wall of the outlet receptacle for engagement with terminals of a junction block. Levers are provided on the back wall of the receptacle block for positioning the terminal ends in alignment with different terminals of the junction block and windowed openings in the front wall expose indices on the levers identifying selected circuits.

10 Claims, 5 Drawing Sheets

OUTLET RECEPTABLE WITH REARRANGEABLE TERMINALS

FIELD OF THE INVENTION

The invention relates to electrical outlet receptacles and more particularly to electrical outlet receptacles having rearrangeable input terminals for selective engagement with any one of a plurality of terminals of an electrical junction block representing different electrical circuits.

BACKGROUND OF THE INVENTION

In the modern office environment and other work locations, the need for electrical power is ever increasing. Furthermore, several separate electrical circuits may be required in one area to accommodate various types of equipment such as computers, communication equipment and the like on independent electrical circuits. The circuit requirements are generally such that for some circuits a ground conductor may be shared whereas for other circuits, e.g., certain computer equipment, an isolated ground circuit may be required. In a similar fashion, some circuits having separate positive conductors may share a common or neutral conductor whereas for other circuits separate positive and common conductors are required. Typical known multiple circuit arrangements provide a power junction block or the like with a plurality of terminals representing a plurality of circuits.

One prior art arrangement as described, for example, in U.S. Pat. No. 4,367,370, dated Jan. 4, 1983, discloses an outlet receptacle block having a ground terminal, a common terminal, and three positive terminals for engaging corresponding terminals of a junction block. The ground and common terminals are connected to the ground and common receptacle output terminals for engagement with the prongs of a standard three-prong electrical cord. The receptacle block further includes a switch which selectively connects one of the three positive prongs to the positive receptacle outlet connector, internal to the outlet receptacle block.

In another prior art arrangement disclosed in U.S. Pat. No. 4,666,223, dated May 19, 1987, an outlet block is provided with a movable terminal to selectively engage one of three positive junction block terminals. The outlet receptacle block of this prior art arrangement includes a conducting shaft electrically connected to the positive outlet terminal of the outlet receptacle block and to the movable terminal. The movable terminal may be slid upwardly or downwardly to a desired position for engagement with one of three positive connector terminals of the power junction block.

In yet another prior art arrangement disclosed in U.S. Pat. No. 4,781,609, dated Nov. 1, 1988, the outlet receptacle block is provided with a pair of slidable terminals mounted on a carrier to assure synchronous movement of the two contacts. The junction block is provided with a ground terminal, three positive and three common terminals defining three separate circuits with a common ground. The carrier on the outlet receptacle block may be positioned so that one of its terminals engages one of the positive terminals of the junction block and the other engages the corresponding common terminal. A sliding electrical contact internal to the receptacle block provides contact between the movable terminals and corresponding terminals for engagement with the prongs of a standard electrical cord.

In each of the above-mentioned prior art arrangements, an electrical switch contact between a movable part and a stationary part is employed to connect the outlet terminals of the outlet receptacle block to its input terminals engaging the power junction block. A disadvantage of these prior art arrangements is that sliding contacts, particularly in a relatively high current environment, introduce resistance and may fail to provide the proper electrical continuity desired. Furthermore, sliding contacts add to the expense of the outlet receptacle block.

SUMMARY OF THE INVENTION

These and other problems and disadvantages of the prior art are overcome in accordance with this invention by means of an electrical outlet receptacle block having a housing and at least one flexible conductor bar having one portion fixedly attached to the housing and electrically connected to one of the outlet receptacle terminals of the receptacle block. An end of the flexible bar is a movable terminal end which may be moved to at least two separate positions for selective alignment with different terminals of a junction block having at least two different circuits. In one particular embodiment, an electrical junction block comprises eight terminals, four positive terminals, two neutral terminals, and two ground terminals; the outlet receptacle block is provided with three conductor bars for connection to positive, neutral, and ground outlet terminals; and the flexible bars may be selectively positioned to connect the ground outlet terminal to either of the two ground junction block terminals, the neutral outlet terminal to either of the two neutral junction block terminals, and the positive outlet terminal to any one of the four positive junction block terminals.

In accordance with one aspect of the invention, the outlet receptacle block is provided with at least one manually operable control lever engaging the movable end of at least one flexible bar, and the receptacle outlet block is provided with a housing having an elongated slot on one surface for accommodating the control lever. The control lever is disposed partially below the surface and has a protuberance extended through the slot. The protuberance is of a generally rectangular shape and fits snugly in the opening to prevent any significant rotation of the protuberance in the opening. The control lever, of which the protuberance is a part, is provided with an opening which engages a longitudinal section of the conductor bar. Movement of the control lever in the slot causes a bending in a portion of the control bar between the control lever and a fixed anchor point of the flexible conductor bar internal to the receptacle outlet block housing. A terminal end portion of the conductor bar extends beyond the control lever substantially perpendicular to an end wall of the receptacle outlet block housing, for engagement with terminals of the junction block.

In accordance with one particular aspect of the invention, the outlet receptacle block comprises a retaining device for retaining each of the control blocks in a predetermined position to prevent movement of the control block due to the bending forces exerted on the control block from the conductor bar. In one particular embodiment, a flexible metallic strap is provided opposite the slotted opening and is provided with a plurality of indentations corresponding to desired terminal positions for engaging the control lever at a plurality of different positions.

In one particular embodiment of the invention, the conductor bars extend longitudinally in a outlet receptacle housing and are provided with end portions extending in openings in opposing end walls of the housing. In accordance with another embodiment, the housing is provided with a front wall and a back wall, and the conducting bars are provided with an extension section extending through the back wall of the housing for engagement with different ones of a plurality of terminals in a junction block. In one configuration, the conductor bars corresponding to the positive and neutral outlet receptacle terminals are engaged by a common control lever to assure synchronized motion of the positive and neutral conductor bars to allow for connection of a plurality of different circuits, each having an assigned positive terminal and a corresponding neutral terminal.

In accordance with one particular aspect of the invention, the outlet receptacle housing is provided with a window opening for displaying indices indicating a selected electrical circuit.

BRIEF DESCRIPTION OF THE DRAWING

An illustrative embodiment of the invention is described in the following detailed description, with reference to the drawing in which.

DETAILED DESCRIPTION

Figure 1:
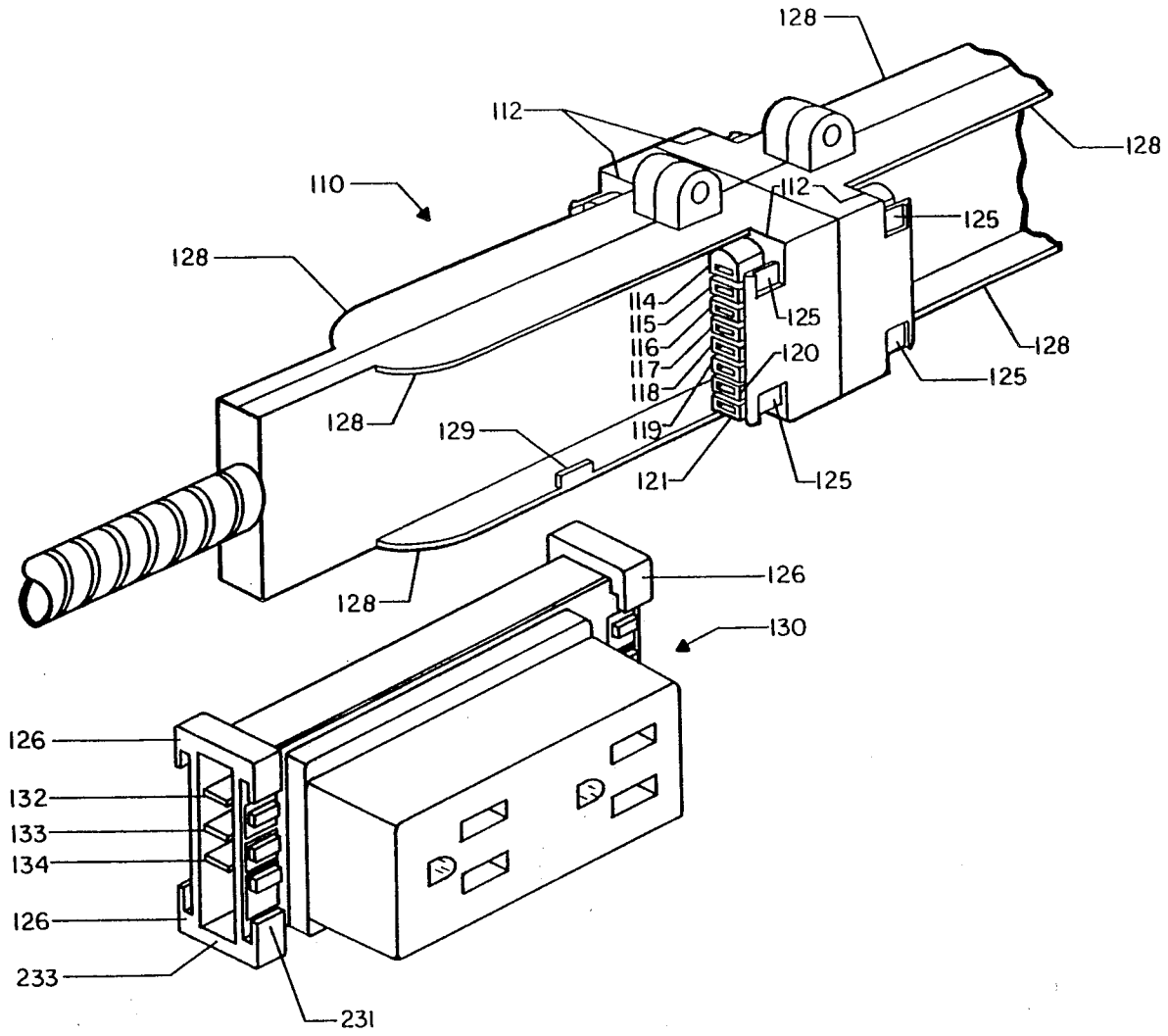
FIG. 1 is a perspective view of an electrical power junction block and an outlet receptacle incorporating the principles of the invention.

FIG. 1 is a perspective view of an electrical junction block 110 of a type which may be used in a raceway of a movable wall panel and which provides electrical outlets as well as electrical power connections to adjoining wall panels. The junction block 110, in this example, is a double-sided junction block having two oppositely facing female connectors 112 on each side of the junction block, thereby providing accommodations for four separate electrical connections. An electrical outlet receptacle block 130 is shown in FIG. 1 and is provided with a set of three male connector terminals at each end. Since a number of independent electrical circuits may be required in a wall panel, the female connector 112 is provided with a plurality of female connector terminals representing several different circuits. In this illustrative embodiment of the invention, the connector 112 comprises eight female terminals 114 through 121 as shown in FIG. 1. By way of example, the lower four terminals 118 through 121 may represent positive wire terminals for four separate circuits. The next two terminals 116 and 117 may represent two separate neutral wire terminals, and the upper two terminals 114 and 115 may represent two separate ground wire terminals. This terminal configuration provides for four separate circuits with some sharing of neutral and ground wire terminals. In order to be able to selectively provide a circuit configuration which consists of any combination of positive, neutral and ground connections at the outlet receptable block 130, the outlet block is provided with independently movable terminals at each end. FIG. 1 shows three such movable terminals 132 through 134 on the left side of the outlet block 130. A corresponding set of switchable terminals (not shown in FIG. 1) is provided on the right side of the outlet block 130. The movable terminals on the left-hand side and the right-hand side of the electrical outlet block are positioned in mirror image of each other about a vertical centerline of the outlet block 130 to allow the outlet block 130 to be inserted in any one of the four connectors 112 of junction block 110. The movable terminals 132 through 134 are positioned by means of the slidable levers 140 through 142, independently movable in slots 145 through 147, respectively, provided for that purpose. Accordingly, any one of the four positive terminal connections 118 through 121 of female connector 112, either one of the neutral terminal connections 116, 117 of female connector 112, and either one of the ground connections 114, 115 of female terminal 112 may be independently selected by selective operation of the slidable levers 140 through 142.

The junction block 110 is provided with support flanges 128 to support an electrical receptable block such as block 130. The lower support flanges may be provided with a tab 129 for appropriate engagement with a slotted area on the lower portion of the receptable block 130 (not shown in the drawing) or other suitable retaining arrangement. One such arrangement is shown in my co-pending application entitled "Electrical Interconnection Assembly," Ser. No. 07/570,879, filed Aug. 22, 1990. The connectors 112 of junction block 110 are provided with latch members 125. Flanges 126 of the receptable block 130 are provided for engagement with the latch members 125.

Figure 2:
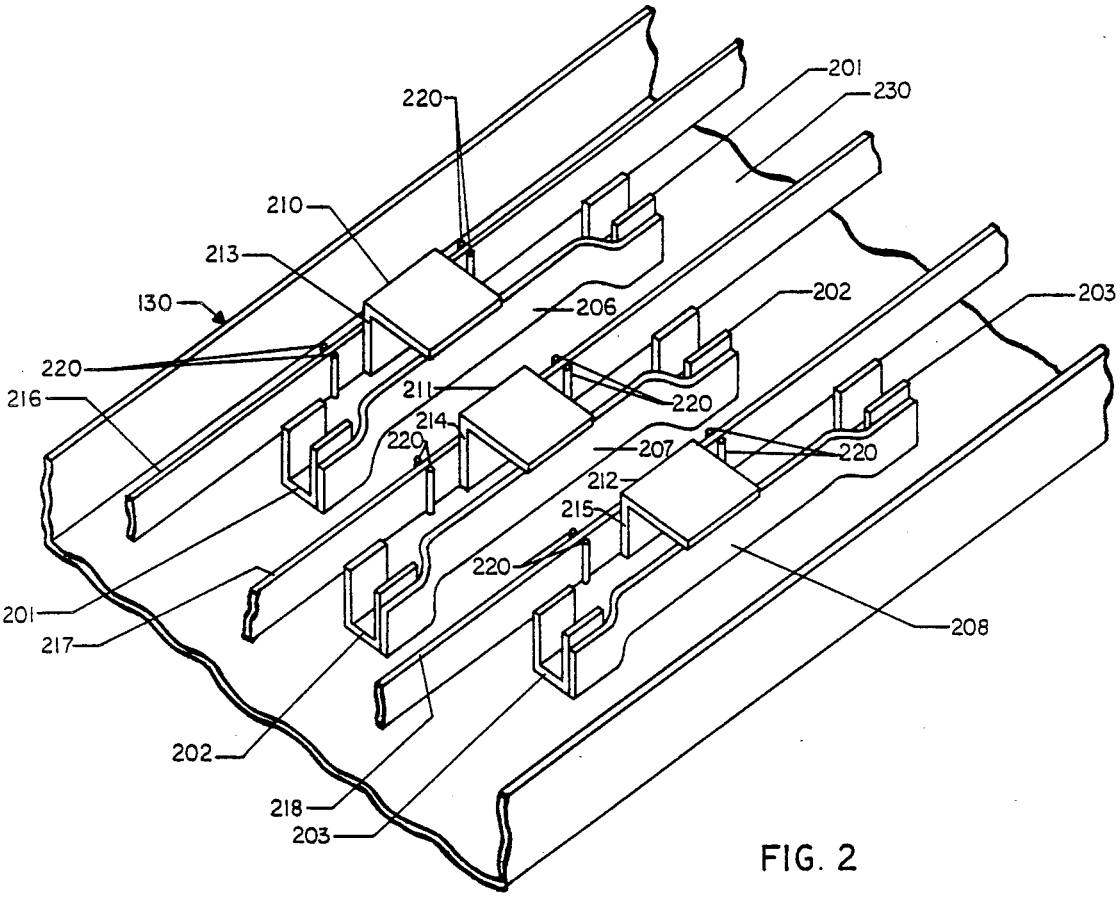
FIG. 2 is a fragmentary perspective cutaway view of the outlet receptacle block of FIG. 1.

FIG. 2 is a partial cutaway view of the receptable outlet block 130, showing a set of neutral receptable connectors 201, a set of ground receptable connectors 202 and a set of positive receptable connectors 203. Connectors 201 are attached to, and electrically interconnected by means of , a horizontally extending interconnecting bar 206. Bar 2-6, in turn, is attached to and electrically connected to an angle support 210 which is attached to, and provides electrical interconnection to, a horizontally extending flexible conductor bar 216. The flexible bar 216 is retained in outlet block 130 by means of retainer posts 220 or other appropriate attaching means, attached to back wall 230. In a similar fashion, ground receptacle connectors 202 are interconnected by means of a horizontally extending interconnecting bar 207 attached to a angle bracket 211, which, in turn, is attached to a horizontally extending flexible bar 217. In the same manner, receptacle connectors 203 are interconnected by means of horizontal interconnecting bar 208 attached to angle bracket 212, which, in turn, is attached to the horizontally extending flexible bar 218. Flexible bars 217 and 218, are positionally maintained by retaining post 220 or other suitable attachment means. Flexible conductor bars 216, 217 and 218 extend between opposite ends of the outlet block 130 and male connectors 132 through 134 are formed integral with bars 216 through 218, respectively. As is apparent from the shape and configuration of the outlet block 130, as depicted in FIG. 1, the receptacle connectors 201 through 203 are positioned at a greater distance from the back wall 230 than the movable terminals 132 through 134 which are formed integral with conductor bars 216 through 218, respectively. The angle brackets 210, 211 and 212 are provided with riser sections 213, 214 and 215, respectively, having a length as required to obtain the appropriate spacing between the receptacle connectors 201, 202, 203 and their corresponding flexible conductor bars 216, 217 and 218, respectively. The receptacle connectors 201, 202, 203 as well as the interconnecting bars 206, 207, 208 and the angle brackets 210, 211, 212 and flexible bars 216, 217 and 218 are made of copper or copper alloy or other conductive material. The housing, including the back wall 230, of the outlet block 130 as well as the junction block 110 may be made of a hard plastic or other suitable insulating material.

Figure 3:
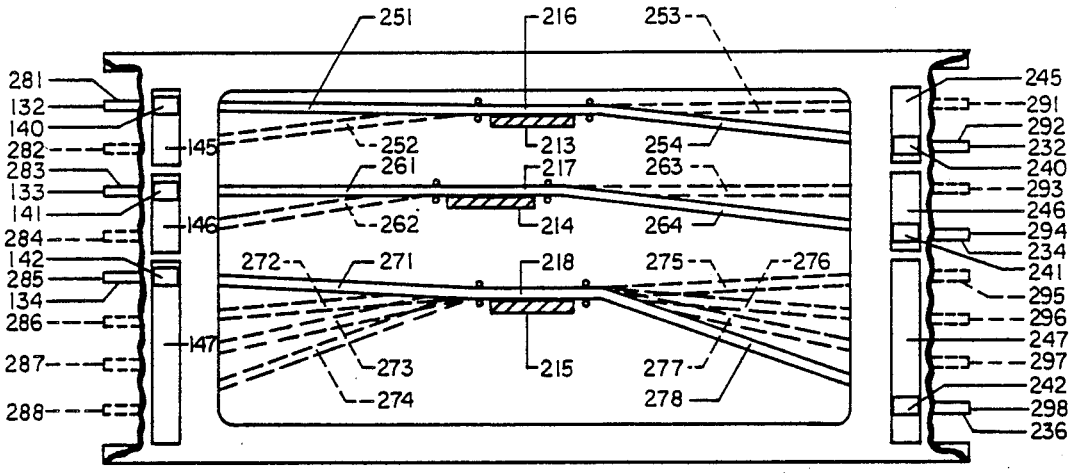
FIG. 3 is a cutaway top view of the junction block of FIG. 1.

FIG. 3 is an enlarged fragmentary front elevation of the outlet block 130 showing movable male terminals 132 through 134 on the left side and movable male terminals 232, 234 and 236 on the right side of outlet block 130. In FIG. 3, the risers 213, 214 and 215 are shown in cross section while the remainder of the angle brackets 211, 210 and 212 and the associated receptacle connectors 201, 202 and 203 are deleted from the view of FIG. 3 for the sake of clarity. Further shown in FIG. 3 are movable control levers 140, 141 and 142 for controlling the selective positioning of left side terminal blades 132, 133 and 134, respectively. Levers 140, 141 and 142 are movable in slots 145, 146 and 147, respectively, to selectively position terminal blade 132 through 134 in alternate positions as shown in phantom in FIG. 3.

Flexible conductor bar 216, which is electrically connected to neutral receptacle connectors 201, as shown in FIG. 2, is shown in FIG. 3 in a position 251. Terminal blade 132, which is formed integral with flexible bar 216, is shown positioned in position 281. Positions 281 and 282, shown in FIG. 3 in phantom, correspond positionally to the locations of terminals 114 and 115 of the connector 112. A sliding movement of levers 140 in slot 145 allows the terminal blade 132 to be moved to position 282, causing a corresponding movement of the left-hand portion of flexible bar 216 from position 251 to position 252. The right-hand portion of flexible bar 216 is shown in position 254 in FIG. 3, and terminal blade 232, formed integral with flexible bar 216 is shown in position 292. This position corresponds to the position of terminal 115 of connector 112. Movement of the slidable levers 240 in slot 245 causes flexible bar 216 to be moved from position 254 to position 253 and causes terminal bade 232 to be moved to position 291. The latter position corresponds to the position of terminal 115 of connector 112. In an analogous fashion, the left-hand portion of flexible bar 217, which is electrically connected to ground terminal connectors 202, may be moved between positions 261 and 262 by means of movement of the sliding lever 141 in slot 146. Such movement causes the terminal blade 133 to be selectively positioned in positions 283 or 284 which correspond to the positions of terminals 116 and 117, respectively, of terminal 112. Similarly, the right-hand portion of flexible bar 217 may be moved between positions 263 and 264 by movement of the slidable lever 241 in slot 246. Accordingly, terminal blade 234, which is formed integral with flexible bar 217, may be moved between positions 293 and 294. The latter two positions correspond to the positions of terminals 116 and 117, respectively, of connector 112. Flexible bar 218 may be positioned in any one of four positions on both the left side and right side of the receptacle outlet block 130 to positions corresponding to four positive wire terminals 118 through 121 of connector 112. The left-hand portion of flexible bar 218 may be moved by a siding motion of the lever 142 in slot 147 between positions 271 through 274. Correspondingly, terminal blade 134, which is formed integral with flexible bar 218, is movable between positions 285 through 288. The latter correspond to the positions of terminals 118 through 121, respectively, of connector 112. In an analogous fashion, the right-hand portion of flexible bar 218 maybe moved between positions 275 through 278 by operation of the slidable lever 242 in slot 247. Accordingly, terminal blade 236, formed integral with flexible bar 218 will be moved between positions 295 through 298, which correspond to the position of terminals 118 through 121, respectively, of terminal 112.

Figure 4:
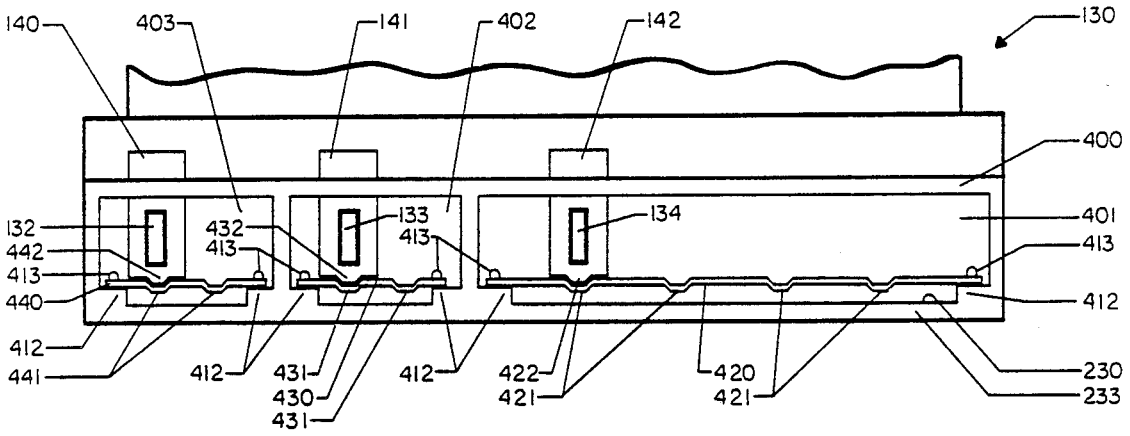
FIG. 4 is a fragmentary side view of the outlet receptacle of FIG. 1.

FIG. 4 is an enlarged fragmentary left side view of outlet receptacle block 130. FIG. 4 shows a left end wall 400 and an opening 401 in the wall 400 to allow for lateral movement of the terminal blade 134 engaged by the slidable lever 142. Positioned within the opening 401 is a flexible plate 420 provided with a plurality of indentations 421, one of such indentations corresponding to each of the four positions for slidable lever 142. A lateral force on lever 142 causes a protuberance 422 on lever 142 to locally depress a portion of the plate 420 and allows the plate 420 to return to the substantially horizontal position when the protuberance 422 engages one of the indentations 421. In this manner, the slidable lever 142 and terminal blade 134 may be selectively positioned in any one of the indentations 421 in alignment with terminals of connector 112. Similarly, terminal blade 133 may be moved by means of movable lever 141 in opening 402 and along flexible plate 430. Flexible plate 430 is provided with indentations 431 for engagement by a protuberance 432 on lever 141. Terminal blade 132 is similarly movable in opening 403 by sliding lever 140 along flexible plate 440 provided with indentations 441. A protuberance 442 on lever 140 engages indentations 441. Flexible plates 420, 430 and 440 may, for example, be fabricated of steel or other alloy having suitable resilient properties. The plates 420, 430 and 440 are supported on raised end sections 412 and may be fastened thereto by means of appropriate fasteners 413.

Figure 5:
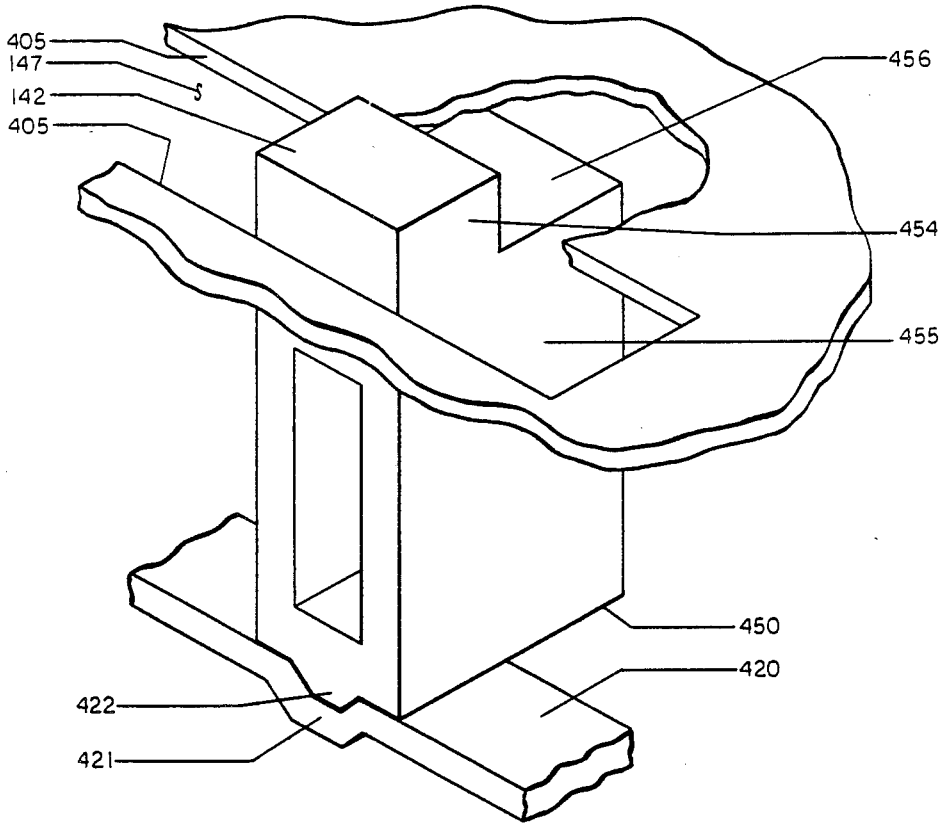
FIG. 5 is an enlarged view of a conductor bar control lever of the outlet receptacle of FIG. 1.
Figure 6:
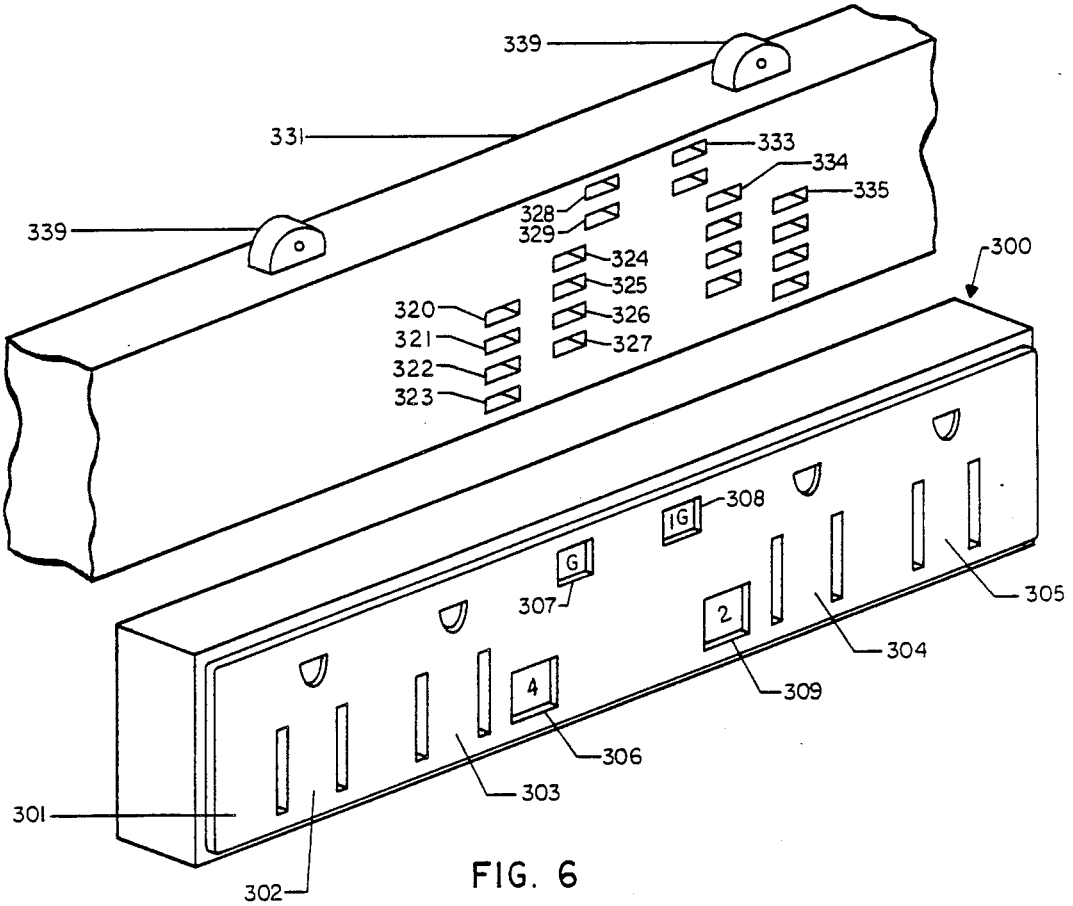
FIG. 6 is a perspective view of an alternate configuration of a junction block and outlet receptable block incorporating the principles of the invention.

FIG. 5 is a fragmentary perspective view of one of the slidable control levers 142, e.g., lever disposed in slot 147, of outlet block 130. The outlet block 130 has a frontal wall 231 which incorporates slots 145, 146 and 147. The control levers 140, 141, and 142 are all constructed in the same manner depicted for control lever 142 in FIG. 5. Lever 142 is provided with a body generally depicted at 450 having an upper portion 454 and a lower portion 455. The lower portion 455 is disposed behind the frontal wall 231 while the upper portion 454 extends beyond the frontal wall 231 for manual contact. The lower portion 455 is provided with a upper surface 456, and control lever body 450 is dimensioned such that the upper surface 456 engages the interior surface of wall 231. Wall 231 and flexible plate 420 cooperate to retain lever 142 in alignment with one of the indentations 421 absent a substantial lateral force on lever 142.

Lever 142 is provided with an opening 452 for accommodating a terminal blade, e.g., 134, (not shown in FIG. 5). The body 450 has a longitudinal dimension in the direction coextensive with the terminal blade, which is substantial, e.g., on the order of one-half inch. As the flexible bar, e.g., 218 of which terminal blade 134 is a part, is moved to a deflected position, a turning force is exerted on control lever 142. This force is counteracted by forces between portions of the wall 231 forming side walls 405 of slot 147 and the upper portion 454 of lever 142. In this manner, the flexible bar 218 is bent as it is moved to a deflected state primarily in the area between retainer post 220 and the switch 142. Advantageously, this arrangement assures that the integrally formed terminal blade 134 extends substantially perpendicular to the left side wall 233 of outlet block 130 and in proper alignment with terminals of connector 112 in each of the four selectable positions. The structure of switch 142 has been described with respect to FIG. 5. Switches 140, 141, 240, 241 and 242 are constructed and operated in the same fashion as the switch 142.

FIGS. 6 through 9 represent an alternate embodiment of the invention. A receptacle block 300 is provided with a front panel 301 having a plurality of outlet receptacles 302 through 305, shown in FIG. 6, and a back panel 330 provided with a plurality of movable connector blades 310 through 315, shown in FIG. 8. The male connector blades 310 through 315 may be selectively inserted in female connectors of the connector junction block 331 of FIG. 6. The junction block 331 may, for example, be a junction block used in a modular wall panel system and suspended by means of lugs 339 in a raceway in a wall panel. Block 331 comprises one group of four female terminal positions 320 through 323. These four terminals are connected to four separate conductors internal to the junction block 331 representing the positive conductor of four separate circuits. In a similar fashion, the four female connectors 324 through 327 are connected to four separate conductors representing the neutral conductor of the same four separate circuits. The male connector blades 314 and 315 are adapted for engagement with one of the female terminals 324 through 327 and one of the terminals 320 through 323, respectively. The blades 314 and 315 are ganged and arranged such that the blade 314 engages a neutral terminal of one of the four separate circuits while blade 315 engages the positive terminal of the same circuit. Ground wires are provided in the junction block 331 and are connected to the two separate ground terminals 328 and 329. One of the ground wires may, for example, be a standard ground, and the other may be an isolated ground reserved for special applications such as certain computer installations. Male connector blade 313 (FIG. 8) may be selectively inserted in either of the female ground terminal positions 328 and 329. In this embodiment, the terminals 313 through 315 are connected to corresponding terminals of outlet receptacles 302 and 303. Accordingly, by selective positioning of the terminal blades 313 through 315, the outlet receptacles 302 and 303 may be arranged for connection to positive and neutral terminals of one of four separate circuits and one of two separate ground wires.

The front panel 301 and back panel 330 of receptacle block 300 and the front panel 332 of junction block 339 are arranged in an essentially symmetrical configuration about a vertically extending centerline. Junction block 331 is provided with four positive terminals 335 which are individually connected to the same set of positive conductors as are connected to the terminals 320 through 323. Similarly, the four terminals of the group indicated at 334 are individually connected to the same four neutral conductors as are connected to terminals 324 through 327, and the two terminals shown at 333 are individually connected to the same ground conductors as the terminals 328 and 329. The male connector blades 310 through 312 are connected to outlet receptacle terminals 304 and 305 and may be selectively positioned to connect the terminals 304 and 305 to any one of the aforementioned four separate circuits and either of the two separate ground conductors.

Figure 8:
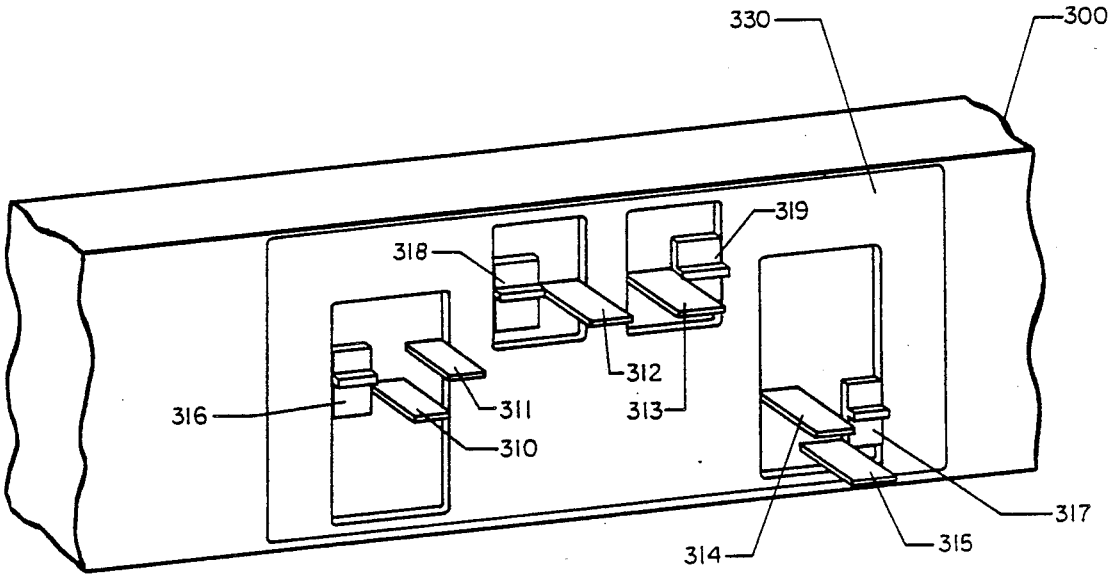
FIG. 8 is a perspective fragmentary view of the back side of the receptacle outlet block of FIG. 6.

The front panel 302 of the receptacle block 300 is provided with a plurality of windows 306 through 309. The windows display numerical indices identifying the selected circuits and ground connection. By way of illustration, the numeral 4 displayed in window 306 shows that the outlet receptacle 302 and 303 are connected to circuit 4 and the G in window 307 shows that the common ground conductor has been selected for these receptacles. In a similar fashion the numeral 2 displayed in window 309 shows that circuit 2 has been selected for receptacle 304 and 305 and the designation IG in window 308 indicates that the isolated ground connection has been selected. FIG. 8 shows selector levers 316 and 317 for selectively controlling the selection of one of four separate circuits for the pairs of outlets 302, 303 and 304, 305, respectively. Selector levers 318 and 319 control the position of the male ground terminal blades 312 and 313, respectively.

Figure 7:
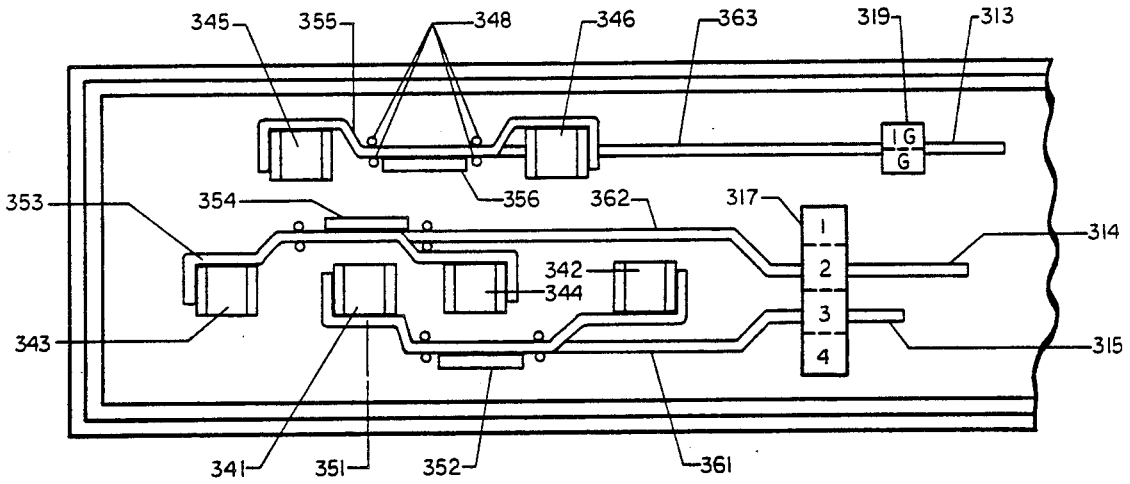
FIG. 7 is a fragmentary cutaway view of the receptacle block of FIG. 6.

FIG. 7 is a partial front view of the outlet block 300 with the panel 301 removed. FIG. 7 shows a pair of positive, electrically interconnected receptacle terminals 341, 342 supported by interconnecting support bar 351. Bar 351 is attached to an interconnecting plate 352 extending from the front to the back of receptacle block 300. A positive flexible conductor bar 361, connected to plate 352, extends generally horizontally and is formed integral with male terminal blade 315 (FIG. 8). In a similar fashion, neutral receptacle terminals 343, 344 are supported by means of an interconnecting support bar 353 attached to plate 354 which extends from the front to the back of receptacle block 300. A neutral flexible conductor bar 362 is connected to plate 354 and is formed integral with male terminal blade 314 (FIG. 8). Ground terminals 345 and 346 are supported by, and electrically interconnected by means of, support bar 355, attached to electrically conductive support plate 356. A ground flexible conductor bar 363 is connected to plate 356 and is formed integral with male terminal blade 313 (FIG. 8). Conductor bars 361 and 362 are ganged together by means of selector lever 317, the other side of which is shown in FIG. 8. Movement of the selector lever 317 will cause both the positive and neutral conductor bars 361 and 362 to be moved simultaneously to engage a selected pair of terminals 320 through 323 and 334 through 327, respectively. The numerals 1 through 4 are shown on selector lever 317 to allow the proper number to be exposed to window 306. Lever 319 is used to move conductor bar 363 and the letter indications G and IG are provided on the lever to allow the appropriate letter to show in window 307. Two pairs of retainer posts 348 are provided to retain the conductor bar 363 and its plate 356 in position within the receptacle block 300. Similar sets of retainer posts are used with conductor bars 361 and 362 but are not individually numbered in the drawing. A mirror image of the arrangement shown in FIG. 7 is contained in the right-hand half of receptacle block 300 for receptacles 304 and 305, but is not shown separately in the drawing.

Figure 9:
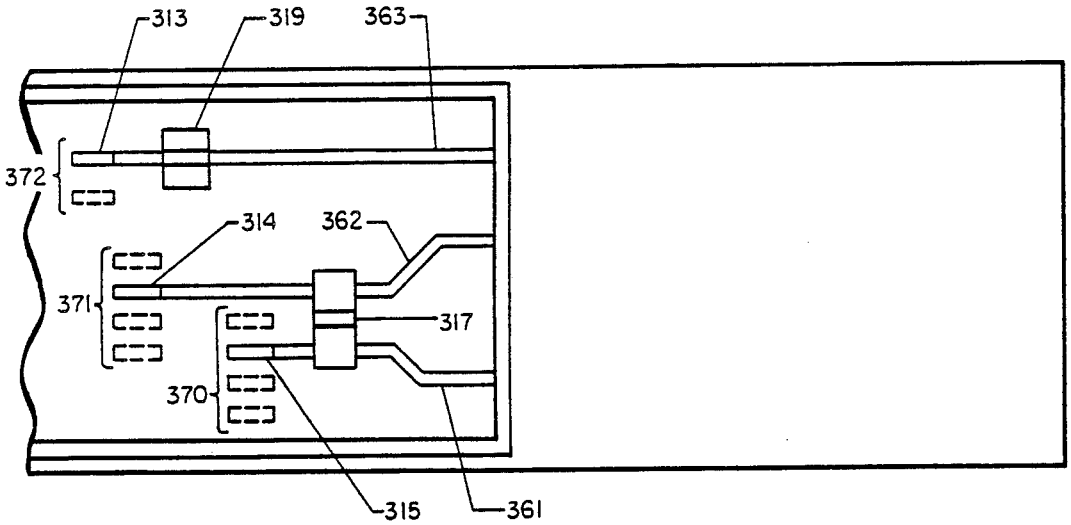
FIG. 9 is a fragmentary cutaway view of the outlet receptacle block of FIG. 6.

FIG. 9 is a fragmentary back elevation of the left-hand portion of receptacle block 300 with the back cover panel 330 removed. FIG. 9 shows the conductor bars 361, 362, and 363 terminating in male terminals 315, 314, and 313, respectively. Further, selector levers 319 and 317 are shown. Brackets 370, 371, and 372 indicate the various selectable positions of conductor bars 361, 362, and 363, respectively. Alternate positions are shown in phantom. The positions indicated by the brackets correspond to the various terminals of terminal sets 320, 321, and 322.

It will be understood that the above-described embodiments are only illustrative of the invention and that numerous other configurations can be devised by those skilled in the art without departing from the spirit and scope of the invention.

What is claimed is:

1. An electrical outlet receptacle block for use with a connector junction block having at least one terminal connected to a conductor of one electrical circuit and at least one terminal connected to a conductor of another electrical circuit, said electrical outlet receptacle block comprising:

a receptacle block housing having a frontal wall comprising a plurality of outlet receptacle terminals;

at least one flexible conductor bar in said housing electrically connected to one of said outlet receptacle terminals, said flexible bar having a portion fixedly attached to said housing and a movable terminal end for engagement with a terminal of said junction block, said terminal end movable to at least two separate positions for selective alignment with different ones of said terminals of said junction block;

an elongated slot in said frontal wall, said slot having side walls extending substantially perpendicular to the direction of said terminal end; and a lever for controlling movement of said flexible conductor bar, said lever comprising a passageway engaging a longitudinal section of said bar for maintaining said terminal end of said bar substantially in alignment with one of said terminals of said junction block and said lever having an upper portion having side walls extending substantially parallel to said side walls of said slot and engaging said side walls of said slot for maintaining said passageway and said terminal end of said bar in alignment for engagement with a terminal of said connector junction block.

2. An electrical outlet receptacle block for use with a connector junction block having at least one terminal connected to a conductor of one electrical circuit and at least one terminal connected to a conductor of another electrical circuit, said electrical outlet receptacle block comprising:

a receptacle block housing having a frontal wall comprising a plurality of outlet receptacle terminals; and at least one flexible conductor bar in said housing electrically connected to one of said outlet receptacle terminals, said flexible bar having a portion fixedly attached to said housing and a movable terminal end for engagement with a terminal of said junction block, said terminal end movable to at least two separate positions for selective alignment with different ones of said terminals of said junction block;

said front wall further comprising an elongated slot, and an inner surface adjacent said slot;

said housing further comprising a rear wall opposite said front wall and having an inner surface and a flexible plate having a plurality of indentations and mounted on said inner surface of said rear wall generally opposite said slot;

said receptacle block further comprising a control lever for controlling movement of said flexible conductor bar, said control lever having an upper portion extending into said slot and a lower portion engaging said bar, said lower portion of said lever having an upper surface for engaging said inner surface of said frontal wall and a lower surface having a protuberance for engaging said indentations of said flexible plate.

3. An electrical outlet receptacle block for use with a connector junction block having at least one terminal connected to a conductor of one electrical circuit and at least one terminal connected to a conductor of another electrical circuit, said electrical outlet receptacle block comprising:

a receptacle block housing having a frontal wall comprising a plurality of outlet receptacle terminals;

at least one side wall extending generally perpendicular to said frontal wall and an opening in said side wall; and at least one flexible conductor bar disposed in said housing electrically connected to one of said outlet receptacle terminals and having a movable terminal end extending in said opening for engaging a terminal of said junction block, said terminal end movable to at least two separate positions for selective alignment with different ones of said terminals of said junction block.

4. The electrical outlet receptacle block in accordance with claim 3 wherein said terminals of said connector junction block comprise at least two positive terminals and two neutral terminals and said outlet receptacle block comprises at least one other flexible conductor bar in said housing electrically connected to one of said outlet receptacle terminals, said other flexible bar having a portion fixedly attached to said housing and a movable terminal end for engagement with terminals of said junction block, and wherein said terminal end of said at least one bar is movable to at least two separate positions for selective alignment with different ones of said positive terminals and said terminal end of said other bar is movable for selective alignment with different ones of said neutral terminals.

5. An electrical outlet receptacle block in accordance with claim 4 wherein said connector junction block comprises at least two ground terminals and said outlet receptacle block comprises a third flexible conductor bar electrically connected to one of said outlet receptacle terminals and having a portion fixedly attached to said housing, said third flexible conductor bar having a terminal end movable to at least two separate positions for selective alignment with different ones of said ground terminals.

6. The electrical outlet receptacle block in accordance with claim 3 wherein said connector junction block comprises a plurality of terminals connected to a set of positive conductors and a plurality of terminals connected to a corresponding set of neutral conductors and said receptacle outlet block comprises a first flexible conductor bar connected to one of said outlet receptacle terminals and a second flexible conductor bar connected to another of said outlet receptacle terminals and said receptacle block comprises a layer engaging said first and said second flexible conductor bars, and wherein movement of said lever causes positioning for selective engagement of said first bar with one of said positive terminals and concomitantly positioning of said second bar for engagement with a corresponding one of said neutral terminals.

7. The outlet receptacle block in accordance with claim 6 wherein said housing comprises a back wall opposite said frontal wall and wherein said lever is accessible from said back wall and comprises one surface having indices identifying a selected circuit and said frontal wall has an opening in register with one of said indices when said lever is in a selected position.

8. The electrical outlet receptacle block in accordance with claim 3 wherein said housing comprises another side wall opposite said at least one side wall and extending generally perpendicular to said frontal wall and an opening in each of said side walls and wherein said flexible conductor bar has a first terminal end extending in said opening of said at least one side wall and a second terminal end extending in said opening of said another side wall.

9. An electrical outlet receptacle block for use with a connector junction block and having a plurality of terminals including a first set of aligned terminals connected to a set of conductors of one polarity and a second aligned set of terminals offset from said first set and connected to a corresponding set of opposite polarity conductors, said electrical outlet receptacle block comprising:

a receptacle block housing comprising a frontal wall having a plurality of outlet receptacle terminals and a rear wall opposite said frontal wall having at least one opening; and a pair of flexible conductor bars, each having a terminal end extending at substantially right angles therefrom and extending through said at least one opening;

said terminal ends offset from one another for simultaneous engagement with terminals of said first set and terminals of said second set, respectively.

10. The electrical outlet receptacle block in accordance with claim 9 wherein said frontal wall has first and second sets of outlet receptacle terminals and said outlet receptacle block comprises a first pair of flexible conductor bars electrically connected said first set of outlet receptacle terminals and a second set of flexible conductor bars electrically connected to said second set of outlet receptacle terminals, said first pair of flexible conductor bars each having a terminal end for engaging a first predefined set of said plurality of receptacle block terminals and said second pair of flexible conductor bars each having a terminal end for engaging a second predefined set of said plurality of receptacle block terminals.

* * * * *

UNITED STATES PATENT AND TRADEMARK OFFICE

CERTIFICATE OF CORRECTION

PATENT NO. : 5,096,431

DATED : March 17, 1992

INVENTOR(S) : NORMAN R. BYRNE

It is certified that error appears in the above-identified patent and that said Letters Patent is hereby corrected as shown below:

In the title:
"RECEPTABLE" should be --RECEPTACLE--.

Col. 10, claim 2, line 4:
"front" should be --frontal--.

Col. 10, claim 2, line 7:
"front" should be --frontal--.

Col. 11, claim 6, line 5:
"layer" should be --lever--.

Signed and Sealed this

Twentieth Day of July, 1993

*Attest:*

Michael K. Kirk

MICHAEL K. KIRK

*Attesting Officer*

*Acting Commissioner of Patents and Trademarks*